US007566217B2

(12) United States Patent
Mörsner

(10) Patent No.: US 7,566,217 B2
(45) Date of Patent: Jul. 28, 2009

(54) VARIABLE ORIFICE COMBUSTOR

(76) Inventor: Johann Carl Mörsner, PO Box 771, 1270 Graskop (ZA)

( * ) Notice: Subject to any disclaimer, the term of this patent is extended or adjusted under 35 U.S.C. 154(b) by 0 days.

(21) Appl. No.: 11/568,093

(22) PCT Filed: Apr. 19, 2005

(86) PCT No.: PCT/ZA2005/000059

§ 371 (c)(1),
(2), (4) Date: Jul. 5, 2007

(87) PCT Pub. No.: WO2005/100859

PCT Pub. Date: Oct. 27, 2005

(65) Prior Publication Data

US 2007/0248920 A1 Oct. 25, 2007

(30) Foreign Application Priority Data

Apr. 19, 2004 (ZA) ..... 2004/2919

(51) Int. Cl.
*F23N 1/02* (2006.01)
*F23C 6/04* (2006.01)

(52) U.S. Cl. ..... 431/12; 431/352; 431/354; 431/186; 431/189; 431/195; 431/197; 431/198; 431/200; 431/201

(58) Field of Classification Search ..... 431/12, 431/186, 189, 198, 350, 352, 354, 195, 197, 431/200, 201
See application file for complete search history.

(56) References Cited

U.S. PATENT DOCUMENTS 812,513 A * 2/1906 Moreno et al. ..... 431/201
1,127,815 A * 2/1915 Shaw ..... 239/414
1,129,140 A * 2/1915 Thexton ..... 431/197
1,702,298 A * 2/1929 Hetsch ..... 110/262
1,976,041 A * 10/1934 Sherman et al. ..... 431/200
2,989,119 A * 6/1961 Burt ..... 431/353
3,331,424 A * 7/1967 Heinrich ..... 236/1 A
3,371,699 A * 3/1968 Riot ..... 48/184
4,008,039 A * 2/1977 Compton et al. ..... 431/90
4,123,220 A 10/1978 Bond et al.
4,150,693 A * 4/1979 Genevey et al. ..... 137/625.3
4,395,223 A 7/1983 Okigami et al.
4,674,973 A * 6/1987 Wright ..... 431/284
4,708,637 A * 11/1987 Dutescu ..... 431/116
4,755,136 A * 7/1988 Gotte ..... 431/354
4,972,878 A * 11/1990 Carlin ..... 137/625.33

(Continued)

*Primary Examiner*—Kenneth B Rinehart
*Assistant Examiner*—Jorge Pereiro
(74) *Attorney, Agent, or Firm*—Wyatt, Tarrant & Combs, LLP; H. Roy Berkenstock

(57) ABSTRACT

A variable orifice combustor unit 10 comprises an annular combustion chamber 12 extending about a central axis 14 and ending in a discharge nozzle 16. Charging of the chamber 12 takes place from combustion fuel and air supply chambers 18 and 20 via a fuel charging orifice array 22 and an air charging orifice array 24. The orifices 28.1, 28.2 of the orifice arrays 22, 24 are positioned and slanted at the same forward angle in the direction of the nozzle 16 to the effect of their central axes 38, 40 cutting along the longitudinal centre of the combustion chamber 12. The cross sectional sizes of the orifices 28 are adjustable by means of an orificed displaceably mounted cyndrically shaped covering body 44 for the fuel charging side and an orificed cylindrical body 58 for the air charging side both being displaceable in the direction of the axis 12.

21 Claims, 3 Drawing Sheets

U.S. PATENT DOCUMENTS 5,277,578 A * 1/1994 Ratnani et al. ..... 431/351
5,915,371 A * 6/1999 Hering ..... 126/9 R
6,634,780 B1 * 10/2003 Stimson et al. ..... 366/23
2004/0065372 A1 * 4/2004 James et al. ..... 137/625.3

* cited by examiner

VARIABLE ORIFICE COMBUSTOR

CROSS-REFERENCE TO RELATED APPLICATIONS

This application claims priority to PCT/ZA2005/000059 filed on Apr. 19, 2005, and ZA2004/2919 filed Apr. 19, 2004, the contents of which are fully incorporated by reference.

STATEMENT REGARDING FEDERALLY SPONSORED RESEARCH OR DEVELOPMENT

Not applicable

REFERENCE TO MICROFICHE APPENDIX

Not applicable

BACKGROUND TO THE INVENTION

The use of directly fired combustors for heating purposes even at high temperatures up to in the order of 1000 degrees C. is common in the industry. The heat loss experienced by conventional directly fired combustors is generally directly proportional to their operating temperatures resulting in a high temperature causing a substantial loss of heat in turn implying an increased fuel consumption. Very high temperatures also produce fatigue in the materials used in the surroundings of a combustor. A lower process temperature requires an intensification of the speed at which convection heat reaches its intended source. While conventional combustors often require specific medium supply pressures a variation therein affects the efficiency of these combustors as they do not have the ability to accommodate a variation in medium supply pressures. The running of combustors at lower temperatures and increased efficiencies further has a beneficial effect on the release of greenhouse gases and urban nitrooxides. It is, amongst others, an object of this invention to address the situations mentioned for improving combustor usefulness and efficiency.

FIELD OF THE INVENTION

This invention relates to a variable orifice combustor employable for performing a mainly convection heating function in serving as a thermo kinetic energiser.

PRIOR ART DESCRIPTION

In the prior art U.S. Pat. No. 4,123,220 differs from the present invention in that the fuel combustion reaction proceeds instantaneously once coming into contact with axially inserted air. No means of controlling flame speed is provided while the main function of this disclosure lies in the dissociation of toxic acids and the creation of radiant heat for recovery. No gas acceleration feature is available.

While U.S. Pat. No. 4,395,223 mentions multi-staged combustion this effect is limited to a maximum of three stages wherever extra fuel is added to reach stoichiometric values. This disclosure, in fact, does not need staged combustion except for nitrous oxides inhibition. The invention also does not disclose a gas acceleration feature.

U.S. Pat. No. 4,708,637 does not present means for regulating injection velocity pressures as is the case with the present invention. A minimal fluctuation of input flows and pressures, when involving this disclosure, creates inadequate mixing causing resultant forces that are non-parallel to jet direction. This in turn minimizes the development of kinetic energy in discharged combusted gases that consequently affects effective convection. The absence of the ability to control injection velocity pressures is detrimental for staged combustion especially at lower operating temperatures thus causing incomplete reaction and overheating while in larger units combustion takes place more radiantly thus creating nitrous oxides because of the lack of vortex formation.

BRIEF DESCRIPTION OF THE DRAWINGS

The invention is now described, by way of example, with reference to the accompanying drawings. In the drawings FIG. 1 in three dimensional rear view shows one embodiment of a combustor, according to the invention.

DETAILED DESCRIPTION OF THE PREFERRED EMBODIMENT

Figure 2:
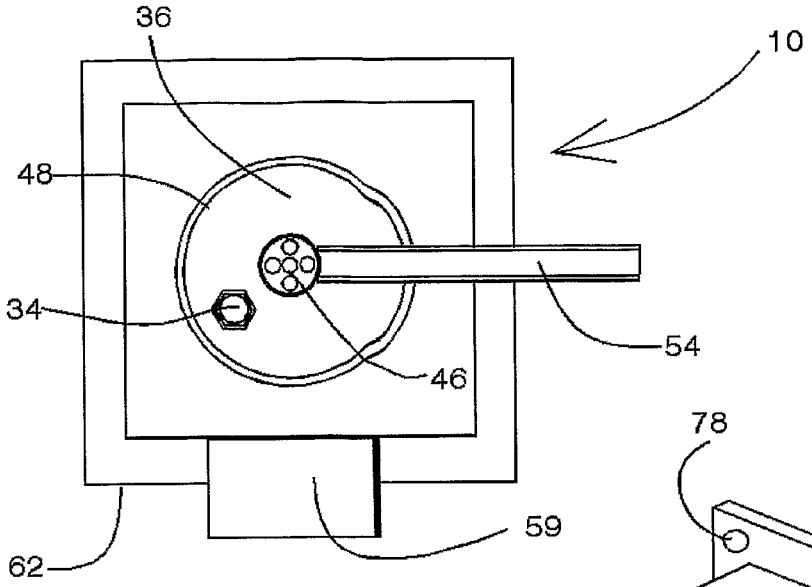
FIG. 2 shows the combustor of FIG. 1 in end elevation in the direction of arrow B in FIG. 1.

Referring to the drawings a variable orifice combustor in the form of a combustor unit is generally indicated by reference numeral 10.

The combustor 10 comprises a combustion chamber 12 extending regularly about a central axis 14 and ending in a progressively constricted combusted medium discharge in the form a discharge nozzle 16 while charging of the chamber 12 takes place from combustion fuel and air supply dispositions in the form of an air charging chamber 18 and a fuel charging chamber 20 via combustion medium orifice arrays in the form of a fuel charging orifice array 22 and an air charging orifice array 24 formed in facing longitudinal walls 26 of the chamber and of which arrays 22, 24 the cross sectional sizes of the orifices 28 are adjustable by means of an adjustment mechanism including displaceably mounted orificed covering means 30 being formed with covering means orifice arrays 32 in number and size matching those of the relevant medium orifice array 22, 24 that they adjustably co-act with. As the size of the medium charging orifices 28 are mechanically adjustable via the covering means 30 the upstream supply of medium is not critical enabling the use of the unit 10 through a range of medium supply pressures. The chamber 12 is exposed to igniting means in the form of a spark plug 34 fitted through its real wall 36. The nozzle 16 can typically converge at an angle of 21 degrees.

Figure 6:
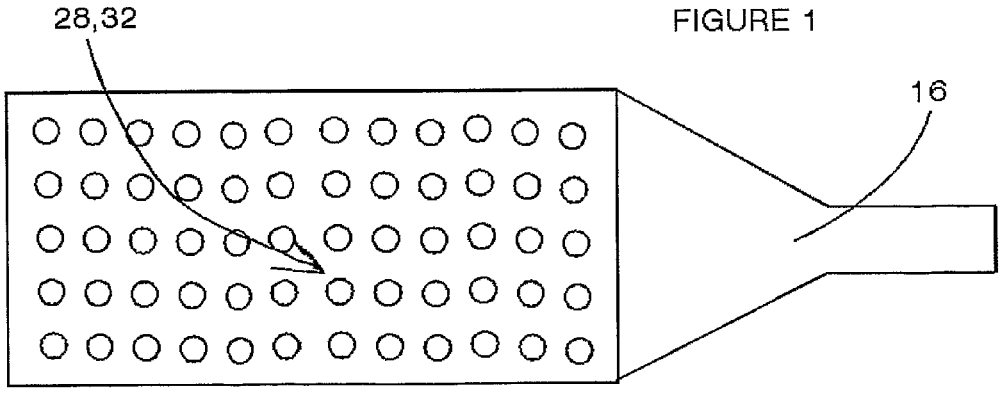
FIG. 6 shows a typical medium charging and covering means orifice array formed though the walls of a combustion chamber of the combustor and the adjusting mechanism used for adjusting the charging of combustion medium to the combustion chamber.

The individual orifices 28.1 of the fuel charging orifice array 22 and the orifices 28.2 of the air charging orifice array 24 are positioned and slanted at the same forward angle in the direction of the nozzle 16 to the effect of the central axes 38 of the fuel charging orifices 28.1 crossing the central axes 40 of corresponding air charging orifices 28.2 along the longitudinal centre 42 of the combustion chamber 12. The orifices of the orifice arrays 32 also follow the direction of the orifices 28.1 and 28.2 resulting in charging taking place along the relevant axes 38 and 40 as also passing along the orifices of the orifice arrays 32 once the unit 10 is in use. The orifices 28 are suitably regularly arranged in rows and columns, as shown in FIG. 6 for a planarly extending array, and interspaced to promote a uniform pressure within the combustion chamber 12 once in use hence ensuring a steady isentropic transformation throughout the chamber 12. The orifice layout also promotes a more efficient combustion reaction owing to the longitudinal orifice spacing being selected to result in overlapping zones of combustion extending about the longitudinal centre 14 of the combustion chamber 12.

The orifices 28.1 of the fuel charging orifice array 22 and its adjustably registerable cover means orifices arrays 32 are conventionally smaller that the orifices 28.2 of the air charging orifice array 24 and its adjustably registerable cover means orifices arrays 32 owing to the volume of air required in a combustion reaction being larger than that of the fuel, whether gas, vapour or liquid.

Figure 1:
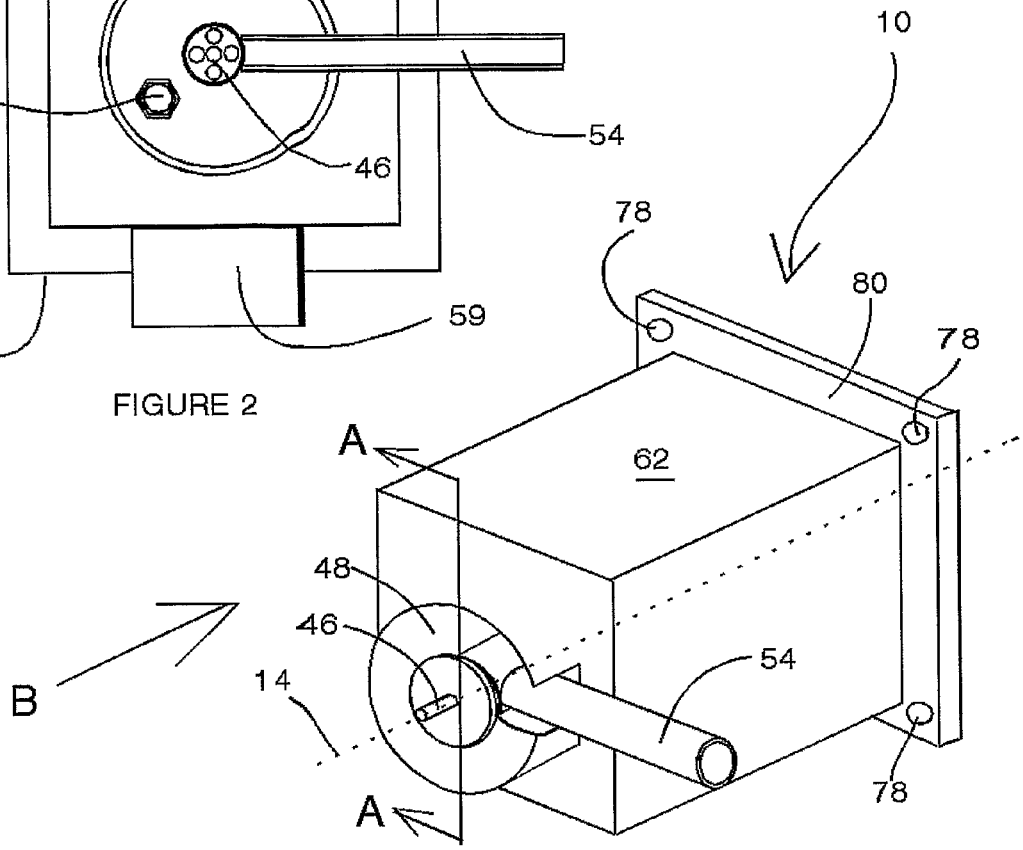
Figure 3:
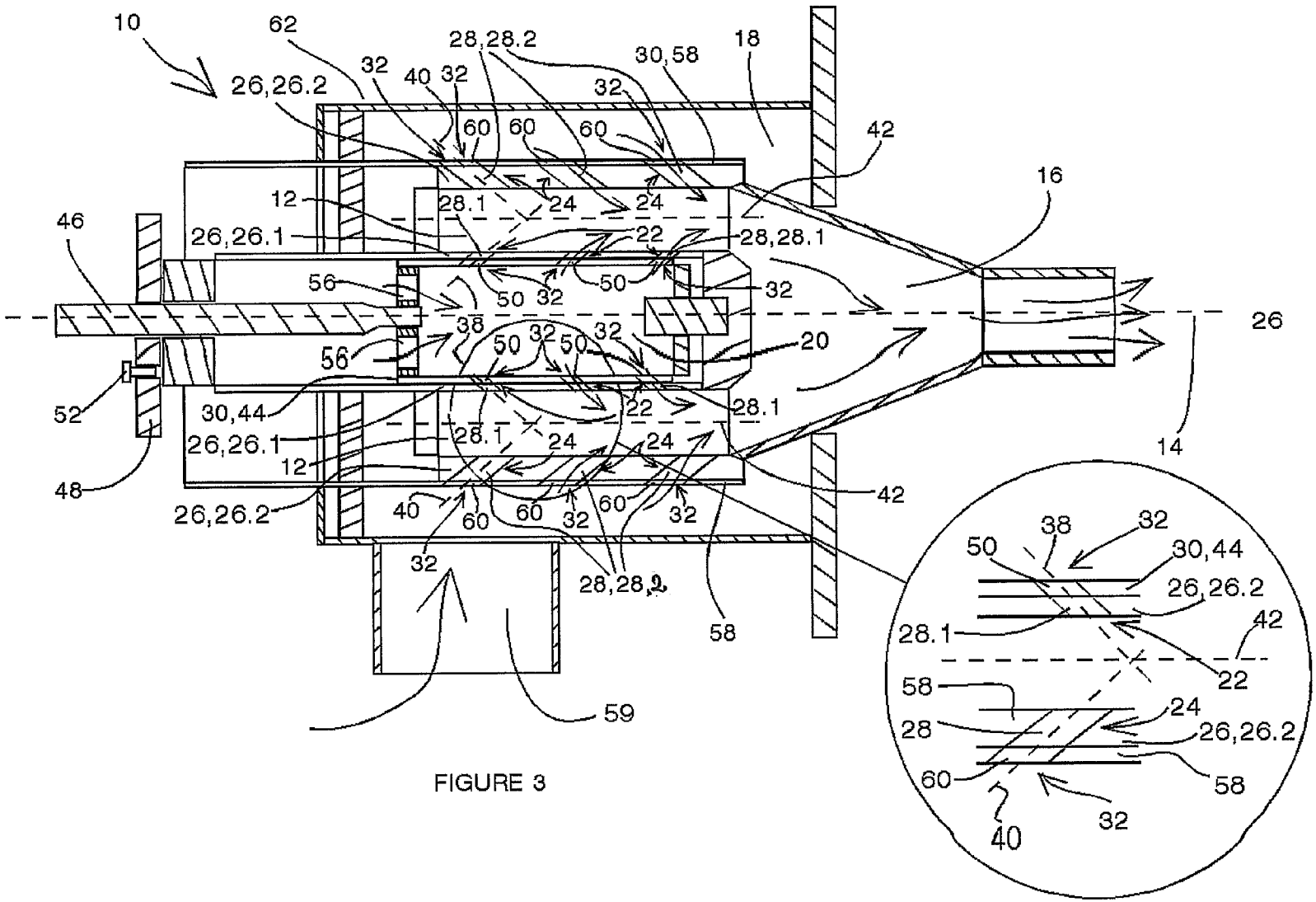
FIG. 3 shows the combustor of FIG. 1 in sectioned side elevation along section line A-A in FIG. 1, FIG. 4 diagrammatically shows another embodiment of the combustor in sectioned side elevation, FIG. 5 diagrammatically shows the combustor of FIG. 4 in rear view.

In referring to FIGS. 1 to 3 and in one embodiment the combustion chamber 12 is annularly formed while the fuel charging chamber 20 extends there within. The air charging chamber 18 annularly encompasses the combustion chamber 12. The orificed covering means 30 is in the case of the fuel charging side in the form of an orificed cylindrically shaped covering body 44 fitted along the inner zone formed adjacent the inside wall 26.1 of the combustion chamber 12. The body 44 is slidably displaceable in the direction of the central axis 14 via a threaded shaft 46 via a fitted threaded shaft passing screw fashion along a manually rotatable adjustment wheel 48. Linear displacement of the body 44 has the effect of adjustment of the sizes of the fuel charging orifices 28.1 on the fuel side adjustment cylinder formed orifices 50 to a larger or lesser extent registering with the fuel charging orifices 28.1. The wheel 48 is fitted with a locking screw 52 via which it is locked against rotation thus locking the orifices 28.1 and 50 in a fixed relationship. Fuel is charged to the fuel charging chamber 20 via a supply conduit 54 and circumferentially spaced inlet apertures 56 opening up in the chamber 20.

On the air charging side the orificed covering means 30 is in the form of a combustion chamber outside cylindrical body 58 formed situated adjacent the outside wall 26.2 of the combustion chamber with the air side adjustment cylinder formed orifices 60. The body 58 is linearly displaceable in the direction of the axis 14 by its pushing or pulling by means of an independent tool. The air charging chamber 18 is supplied via an air feed supply 59.

The cylindrical body 44 fitted with its shaft 46 running along the wheel 48 and the cylindrical body 58 as appropriately adjustable form the orifice adjustment mechanism of this embodiment 15 of the invention.

The unit 10 is conventionally fitted with a appropriate seals to limit the loss charging medium to the environment. The unit 10 of this embodiment is naturally enclosed within a housing 62.

Figure 4:
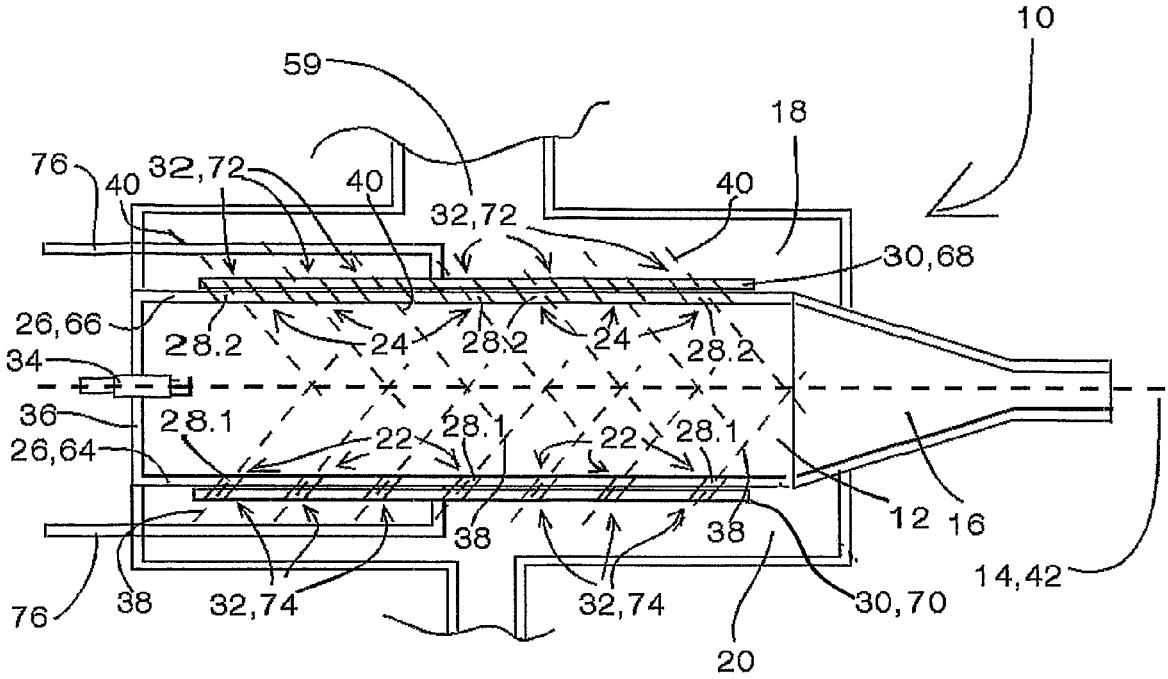
Figure 5:
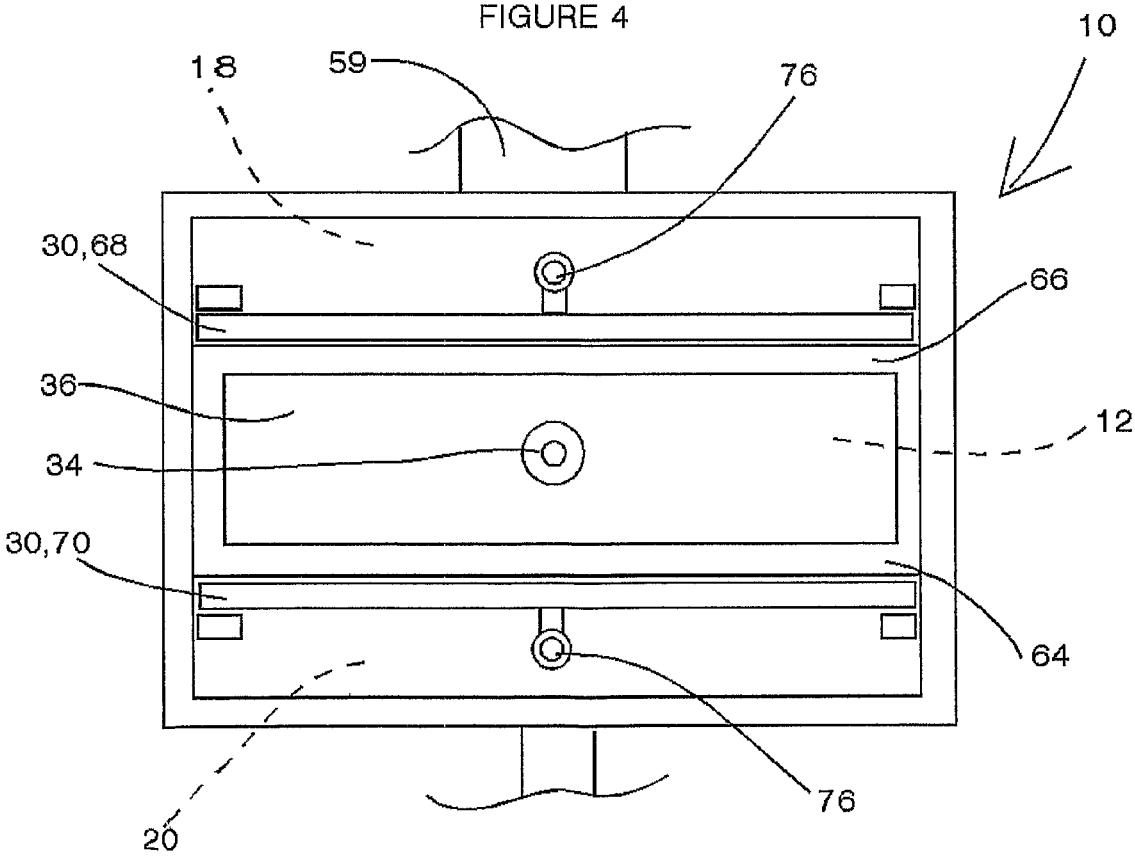

In another embodiment and referring to FIGS. 4 and 5 the combustion chamber 12 is in the form of a rectangular zone arranged to extend about the central axis 14 of the unit 10 that also forms the centre of the chamber 12. Opposite side walls 64 and 66 are respectively formed with the fuel charging orifice array 22 and the air charging orifice array 24.

The orificed covering means 30 is in the form of slidably mounted orificed plates 68 and 70 respectively being formed with the air charging side adjustment orifice array 72 and the fuel charging side adjustment orifice array 74 forming the covering means orifice arrays 32. The plates 68, 70 are mounted to being linearly displaced in the direction of axis 14 by way of handles 76. The plates 68 and 70 with their handles 76 form the adjustment mechanism of this embodiment.

While not shown the unit 10 of the FIGS. 4 and 5 embodiment is naturally also enclosed in a housing.

As the unit 10 runs at high temperatures it is conventionally manufactured from heat resistant material including stainless heat resistant steel alloys or the like.

While the combustor in the form of a unit 10, it is easily manufactured to directly replace conventional units by retrofitting. As shown in FIG. 1 it is thus simply boltable to the equipment requiring heat firing via apertures 78 in a front flange 80.

Once operatively installed and burning in response to the initial charge being ignited by the spark plug 34 the convectional heating effect of the unit 10 is adjustable by simply adjusting the appropriate covering means orifice array 32, whether by way of the wheel 48 or the appropriate plate 70 for the fuel side charging or the cylindrical body 58 or the plate 68 the air side charging.

Owing to the acceleration of the stream of combusted gases though the nozzle 16 heat loss from the combustion reaction to the location of heat application is curtailed enabling obtaining a desired temperature at a lower combustion temperature. The sidewall formed orifices and their way of arrangement has the effect of concentrating the combustion reaction towards the centre of the combustion chamber thus improving the efficiency of the reaction while the charging of appropriate medium is easily controlled by the alteration of the cross sectional areas of the medium charging orifices thereby also easily accommodating a change in the supply pressure of combustion medium.

It is an advantage of the combustor unit 10 as specifically described that the charging of medium to the combustion chamber is easily controllable while the configuration of the charging and adjustment orifices promotes the burning efficiency of charged medium. Another advantage is found in the acceleration of combusted gases via the nozzle to limit a loss of heat between the combustor and its heating target.

The invention claimed is:

1. A combustor (10) employable for performing a mainly convection heating function in serving as thermo kinetic energiser comprising a combustion chamber (12) extending regularly about a central axis (14) and having an axially extending side wall (26, 64, 66) of which at least part of is formed with an array (22) of fuel charging orifices (28.1) and an array (24) of air charging orifices (28.2) each facing inwardly at a similar slanted angle to supply fuel and air into a common combustion zone along the combustion chamber (12) with the openings of the fuel charging orifices (28.1) standing in the side wall in an opposing relationship to those of the air charging orifices (28.2) to achieve an effective combustion reaction, a progressively constricted combusted medium discharge nozzle (16) at the discharge end for accelerating the discharge velocity of combusted medium, and a combustion fuel supply chamber (20) and air supply chamber (18) opening respectively into the fuel charging orifice array (22) and the air charging orifice array (24) each being connected to a cooperating fuel supply orifice array (50) and an air supply orifice array (60) of the relevant medium, whether fuel or air, while the combustion chamber (12) is exposable to igniting means (34) for igniting a combustible mixture once the combustor is in use;

said combustor further characterised in that the effective cross sectional orifice area of the plurality of cooperating orifices (28) of the orifice arrays (22, 24) is adjusted by means of an adjustment mechanism (30, 44, 46, 48, 58, 68, 70, 76) including a slideable cover (58, 30) disposed intermediate the side wall (26, 64, 66) of the combustion chamber (12) and at least one of the fuel supply chamber (20) and air supply chamber (18), said cover formed with an array of fuel supply orifices and an array of air supply orifices, said orifices having an array pattern similar to the respective combustion chamber fuel and air supply arrays, whereby slidably adjusting the extent of the overlap of the respective orifice arrays of the appropriate medium charging orifice array (22, 24) though the independent adjustment of the fuel or air supply cover arrays in the relevant cover.

2. A combustor as claimed in claim 1 in which the individual orifices (28) of the arrays (22, 24) are positioned and aimed to result in the central axes (40) of at least the majority of air charging orifices (28.2) crossing the central axes (38) of corresponding fuel charging orifices (28.1) along the longitudinal centre (14, 42) of the combustion chamber (12) that in the appropriate case corresponds with its the central axis (14).

3. A combustor as claimed in claim 2 in which the medium charging orifice arrays (22,24) each has an equal number of orifices (28).

4. A combustor as claimed in claim 3 in which the orifices (28) of the arrays (22,24) are regularly spaced.

5. A combustor as claimed in claim 4 in which the orifices (28) of the arrays (22, 24) are spaced in rows and columns.

6. A combustor as claimed in claim 1 in which at least substantially all the orifices (28) are slanted at the same angle relative to the longitudinal centre (14, 42) of the combustion chamber (12) in the discharge direction of the burner.

7. A combustor as claimed in claim 6 in which the adjustment mechanism (30, 44, 46, 48, 58, 68, 70, 76) includes covering means (30, 44, 58, 68, 70) for the at least one adjustable medium charging orifice array (22, 24) formed with a covering means orifice array (32, 72, 74) matching that of the medium charging orifice array (22, 24) it adjustably co-acts with in response to the relative parallel displacement of the covering means and the medium charging array presenting walls (26, 64, 66) of the combustion chamber (12), as lying snugly against one another, between conditions of at least extensive orifice registration-and constricted orifice registration thereby to adjust the flow of relevant medium into the combustion chamber during use of the combustor.

8. A combustor as claimed in claim 7 in which the combustion chamber (12) is constituted to cause the medium charging orifice arrays (22, 24) to face one another.

9. A combustor as claimed in claim 8 in which the combustion chamber (12) is annularly formed about a centrally extending medium charging chamber (20) along which the central axis (12) extends resulting in its longitudinal centre (42) extending centrally annularly within the combustion chamber (12) causing the medium charging orifice arrays (22, 24) to extend along the facing circumferential walls (26.1, 26.2) defining the longitudinal inner and outer side walls of the chamber with the inner end of the chamber being appropriately blanked off.

10. A combustor as claimed in claim 9 in which the orifice size of the at least one medium charging array (22, 24) is adjustable in response to the covering means (30), as in the form of a cylindrically shaped covering body (30, 44, 58), being mounted to be slidably displaced along the surface of the relevant combustion chamber defining wall (26) remote from the combustion chamber, whether within the centrally extending medium charging chamber (20) or along the outside of the outer longitudinally extending combustion chamber encompassing wall (26.2).

11. A combustor as claimed in claim 10 in which the covering body (44, 58) is mounted to be controllably displaced in the direction of the central axis (14) of the burner.

12. A combustor as claimed in claim 11 of which both medium charging orifice arrays (22, 24) are adjustable via appropriately orificed cylindrically shaped covering bodies (44, 58).

13. A combustor as claimed in claim 9 in which the combustion fuel and air supply disposition (18, 20) is in the form of appropriately replenishable charging chambers the one extending within the inside longitudinal wall (26.1) and the other along the outside wall (26.2) of the combustion chamber.

14. A combustor as claimed in claim 13 in which the fuel charging chamber (20) is situated within the combustion chamber (12) and the air charging chamber (18) along its outside.

15. A combustor as claimed in claim 8 in which the combustion chamber (12), as appropriately blanked off at its inner end, extend s along the central axis (14) as thus defining its longitudinal centre (42), the adjustment mechanism (30, 44, 68, 70, 76) when in the form of covering means that adjustably co-acts with the at least one medium charging orifice array (22, 24) in adjusting its orifice size, being slidably mounted to the outside surface of the appropriate longitudinal wall (26, 64, 66) of the combustion chamber (12).

16. A combustor as claimed in claim 15 in which the combustion fuel and air supply disposition (18, 20) is in the form of appropriately replenishable charging chambers extending alongside the appropriate side walls (64, 66) of the combustion chamber.

17. A combustor as claimed in claim 15 in which the combustion chamber (12) is formed with planar side walls of which at least some are formed with medium charging orifices (28).

18. A combustor as claimed in claim 17 in which the covering means (30, 68, 70) is in the form of at least one orificed covering plate (68, 70) mounted to be displaced between stops in the direction of the central axis (14) of the combustion chamber.

19. A combustor as claimed in claim 17 in which the combustion chamber (12) is rectangularly shaped.

20. A combustor as claimed in claim 18 in which two facing side walls (68, 70) of the combustion chamber are formed with medium charging orifices (28), the one thus with the air and the other with the fuel charging orifices.

21. A combustor as claimed in any one of claim 18 of which both the air and fuel charging orifice arrays (28.1, 28.2) are adjustable via appropriately orifice covering plates (68, 70).

* * * * *